United States Patent [19]

Smith

[11] 4,403,433

[45] Sep. 13, 1983

[54] SNOW BLOWER AUXILIARY FOR ROTARY LAWN MOWER

[75] Inventor: Delmar A. Smith, Kokomo, Ind.

[73] Assignee: Richard L. Rayl, Kokomo, Ind. ; a part interest

[21] Appl. No.: 334,434

[22] Filed: Dec. 24, 1981

[51] Int. Cl.[3] ..... E01H 5/09

[52] U.S. Cl. ..... 37/243; 56/16.9

[58] Field of Search ..... 37/243, 260; 56/2, 16.9, 56/DIG. 9; 474/25-27, 46, 59, 101, 135, 138, 148

[56] References Cited

U.S. PATENT DOCUMENTS

| | | | |
|---|---|---|---|
| 3,029,533 | 4/1962 | Schwanke et al. | 56/16.9 X |
| 3,131,491 | 5/1964 | Durrschmidt | 37/243 |
| 3,319,363 | 5/1967 | Kennedy | 37/243 |
| 4,104,812 | 8/1978 | Stribiak, Jr. | 37/243 |
| 4,308,676 | 1/1982 | Doane | 37/243 |

*Primary Examiner*—Edgar S. Burr

*Assistant Examiner*—Moshe I. Cohen

*Attorney, Agent, or Firm*—Robert A. Spray

[57] ABSTRACT

A snow blower auxiliary for a rotary lawn mower easily attachable to the deck of the lawn mower, and which is powered by a drive belt connected to the mower's power shaft which normally would power the mower's cutter blade. The drive belt powers a vertical power shaft of the snow blower auxiliary; and that vertical power shaft passes through a relatively stationary body member through which also passes a horizontal drive shaft which powers the snow blower, and which provides a pressure means by which a spring means is able to swing the vertical power shaft in a manner to exert and maintain the desirable tension in the power belt. The auxiliary thus provides a conversion unit for achieving snow blower operativity of the lawn mower; and it provides advantages of low cost, lack of need of an auxiliary engine means, convenience of storage, off-season usage of the lawn mower's power means, etc.

2 Claims, 3 Drawing Figures

SNOW BLOWER AUXILIARY FOR ROTARY LAWN MOWER

Figure 1:
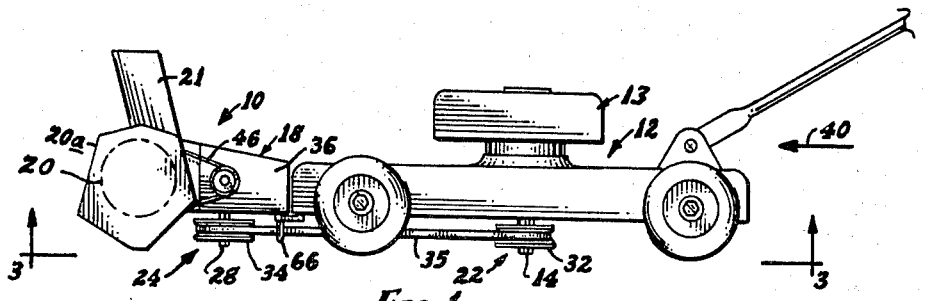

The present invention relates to snow blowers.

More particularly, the present invention relates to a snow blower auxiliary for use as an attachment for a rotary power lawn mower.

Concepts of the invention provide a snow blower auxiliary which is easily attachable to a power lawn mower (rotary type), by which the power of the lawn mower engine is utilized to power the snow blower.

The concepts further provide that the snow blower auxiliary is readily and conveniently attachable and removable from the lawn mower, as an easy operation, requiring hardly any particular amount of mechanical aptitude of the use, and requiring no tools except a common tool such as a wrench or a screwdriver.

Further, the concepts achieve a snow blower attachment for a lawn mower by a mechanism which is easy to use, and which achieves very satisfactory snow blower performance.

An advantage of economy is achieved by several respects, as now detailed.

An economy is achieved by the fact that although the invention achieves the powered operativity of an engine-powered snow blower, its power is from the mower instead of its own. Thus economy is achieved by the lack of having to provide an engine specifically for the snow blower.

Economy is further achieved by the lack of need to supply much storage space for the snow blower; for, not having an engine, nor wheels, it is of light weight and of small bulk, such that it may be easily stored in an on-the-wall or even overhead storage location, taking up no floor space.

Further, economy is achieved by the lack of having to maintain an engine in addition to the lawn mower engine. And, even as to the lawn mower engine itself, its off-season usage as a snow blower is considered by some as being helpful in contrast to it just remaining idle for the entirety of the many months between grass-growing and lawn-cutting seasons.

A particular achievement of the snow blower according to the present invention is that it economically provides for desired tightness or tension of the power belt, eliminating any requirement for the provision of an idler pulley or the like.

This desired tensioning is advantageously achieved by the use merely of a spring applied to a portion of the power drive of the snow blower, and by the concept of the snow blower's power drive being such that the pulley shaft carrying its power belt pulley is itself movably carried by a relatively stationary body member which is itself movably carried by another member of the power drive, providing that the action of the spring against the body member is effective to urge the pulley shaft into a belt-tightening direction, thus applying and keeping satisfactory belt tension without the need of any belt-tightening idler.

Convenience of assembly and removal is advantageously achieved by providing that the only mounting connection of the snow blower auxiliary to the lawn mower is merely by a simple connection of mounting means to the edge of the skirt of the lawn mower deck, and an interchange of a pulley for the lawn mower's cutter blade. No holes need be drilled, nor other adaptation needed.

The connection or assembly of the snow blower auxiliary to the lawn mower, and the subsequent disassembly thereof, is so simple and convenient that hardly any instructions are needed, and in contrast to being at all difficult are practically obvious to the user.

The concepts provide a minimum of danger to the user; for the power drive is all hidden below the lawn mower deck and by the snow blower component itself.

Utility is enhanced by the concepts which provide that a single size of snow blower attachment will fit most all sizes and makes of rotary lawn mowers, with no adaptation for differing lawn mower sizes needing to be made whatever, except only that of the need for the power belt being provided of a size to reach the lawn mower's drive shaft, with the snow blower auxiliary being positioned exteriorly of the lawn mower deck skirt.

The nature of the inventive concepts may perhaps be more easily understood by considering the prior art discovered on a search after this invention was made, that prior art being as follows: U.S. Pat. No. 3,319,363, issued May 16, 1967 to Kennedy; U.S. Pat. No. 3,131,491 issued May 5, 1964, to Durrschmidt; and U.S. Pat. No. 4,104,812, issued Aug. 8, 1978, to Stribiak.

The patent to Stribiak is perhaps the least remote. However, it seems that the Stribiak device is considerably more complex, as to both construction cost and as to installation by a homeowner, than is the present invention, as is apparent even by a comparison of the drawings, and by observing the need of Stribiak for the idler pulley arrangement (82–96), and the relative difficulty a homeowner would face in assemblying a Stribiak snow blower to his lawn mower.

Figure 2:
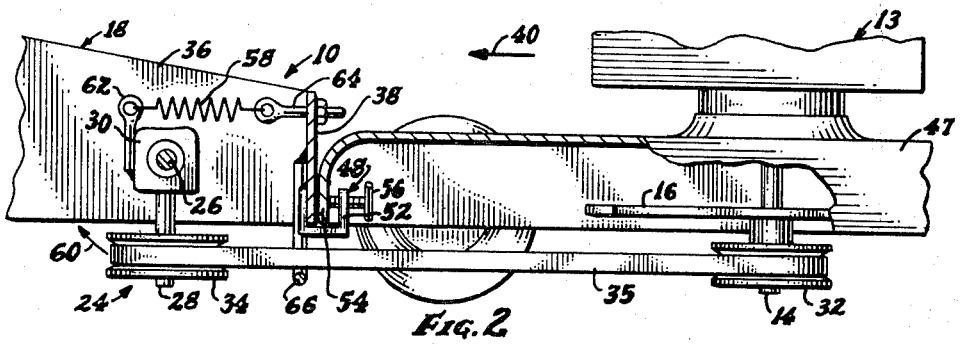
Figure 3:
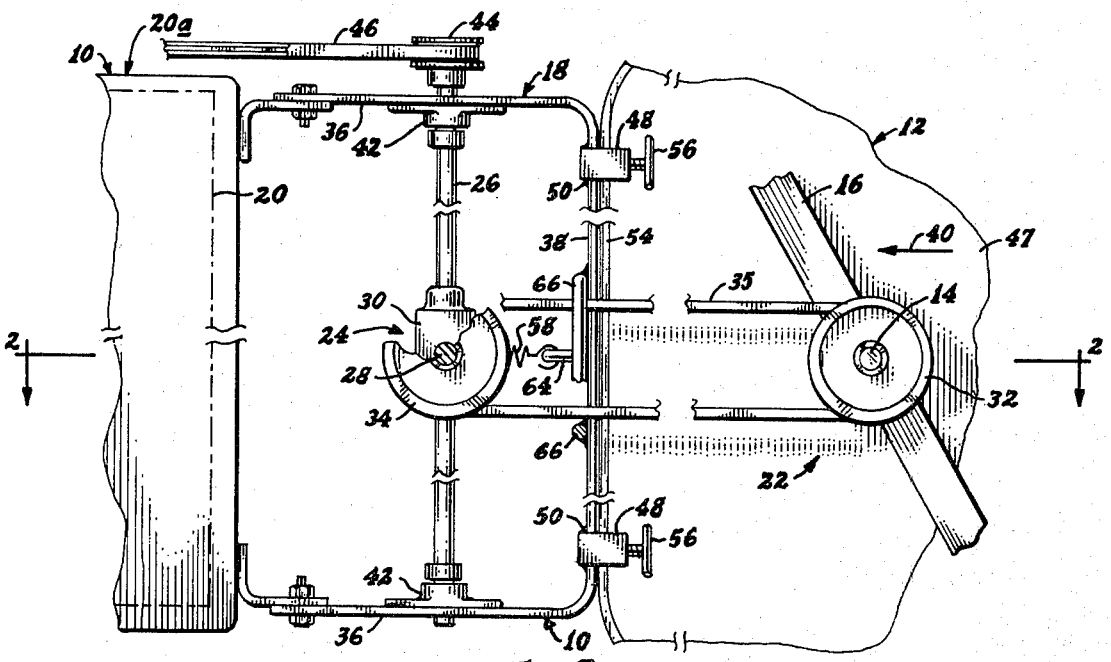

The above is of introductory and somewhat generalized nature. More particular details and concepts are specified in the following more detailed description of an illustrative embodiment, taken in conjunction with the accompanying somewhat schematic drawings, in which:

FIG. 1 is an elevation view of a snow blower auxiliary mounted onto a conventional rotary-type of a power lawn mower device;

FIG. 2, in larger scale, is a longitudinal cross-sectional view of the assembly shown in FIG. 1, the view being that generally as taken by Section-line 2—2 of FIG. 3; and FIG. 3, is an underneath view of the assembly shown in FIG. 1, this view being that generally as shown by View-line 3—3 of FIG. 1;

(The drawings are somewhat diagrammatic in nature for illustration of the inventive concepts, and portions are shown as broken away, per conventional drawing procedures.)

As shown in the drawings, the inventive concepts provide a snow blower auxiliary 10 as an attachment for a rotary lawn mower 12, i.e., a lawn mower having a power means 13 and having a vertical power shaft 14 which is provided for normal use for spinning the cutter blade and flywheel 16 of the lawn mower 12; and it is for such a power mower that the snow blower 10 that this invention relates, as an easily attachable and easily removable auxiliary.

The snow blower means, as shown, is provided as a type having as two of its more obvious primary components a support means 18 and a rotatable means 20 in a housing **20*a* by which the snow encountered by the device 10 is gathered and forcibly ejected, outwardly of a chute 21, although the rotatable means itself 20, 20a** may be that of a conventional snow blower device.

The blower auxiliary 10, more particularly, includes a first power means 22; and the first power means 22 receives power drive from the vertical power shaft 14 of the lawn mower 12, i.e., the shaft which normally is used for driving the cutter blade of the mower 12, although in use of a snow blower 10 the cutter blade is first removed from the shaft 14 and stored.

Also, the blower 10 includes a second drive means 24 by which the power drive of the first power means 22 is utilized to drive the rotatable means 20 of the snow blower 10.

The second drive means 24 includes a horizontal power shaft 26 extending laterally across the blower device 10, and a vertical drive shaft 28 which is operatively interconnected for power-transmission of power, which is received through the vertical drive shaft 28 and powers the horizontal power shaft 26 from the vertical drive shaft 28. The second drive means 24 also includes a relatively stationary body member means 30 which provides a support means with respect to which both the horizontal power shaft 26 and the vertical drive shaft 28 are relatively movable, as more hereinafter apparent.

For powering the unit, the first power means 22 includes a driver means shown as pulley 32 which is connected to the vertical drive shaft 14, and also includes driven means shown as a pulley 34 drivably interconnecting the first power means 22 and the second drive means 24. Pulleys 32 and 34 are drivingly interconnected by a pulley belt 35.

The support means 18 of the snow blower unit 10 is shown as a sturdy frame of a general U-shape, having side walls 36 and rear wall 38, the term "rear" meaning the rearward direction in use, i.e., when the snow blower 10 is mounted on the mower 12 and the assembly is pushed as indicated by directional arrow 40.

The side walls 36 are provided with bearing means 42 for supporting the horizontal power shaft 26, permitting revolving movement of that shaft 26 which through an outward pulley 44 and pulley belt 46 powers the blower's rotatable means 20.

The side walls 36 of the frame 18 provide a support means which supportingly interconnects the bearing means 42 to both the support member of the snow blower means 10, i.e., the frame's rear wall 38, and to the deck 47 of the lawn mower 12.

That attachment, of the blower device 10 to the mower 12, is shown as merely a pair of U-shaped clamps 48 which are attached as by welds 50 to the inside wall of rear wall 38, the rear wall 52 of those clamps 48 being disposed rearwardly of the front wall or skirt 54 of the housing or deck 47 of the mower 12, and the assembly being held by a set-screw 56 of each bracket 48.

Spring means shown as a single tension spring 58 operatively interconnect the relatively stationary body member means 30 and also the lawn mower deck 47 to bias the driven pulley 34 in a direction (reference arrow 60) for applying tightness to the power belt 35 (of pulleys 32,34), the spring 58 being shown as attached to an eyelet 62 above the axis of the horizontal shaft 26. The rearward end of spring 58 is attached to an eyelet 64 mounted on the rear wall 38 of the frame member 18.

A pulley guide 66 of a general U-shape is also mounted on the frame's rear wall 38.

In operation, the mower's power unit 13 drives the driver pulley 32, belt 35, and driven pulley 34, the tension in belt 35 being automatically maintained by the spring 58. The rotation of pulley 34 drives the vertical shaft 28, and, through gearing not shown drives the horizontal drive shaft 26. The drive of shaft 26, through pulley 44 and belt 46, thereupon drives the snow-moving rotatable means 20.

It is thus seen that a snowblow auxiliary according to the inventive concepts provides a desired and advantageous device, yielding the advantages of an economical construction, ease of assembly onto a lawn mower, ease of disassembly from the mower, and automatic drive belt tightening.

Accordingly, it will thus be seen from the foregoing description of the invention according to this illustrative embodiment, considered with the accompanying drawings, that the present invention provides new and useful concepts of a snow blower auxiliary for a rotary lawn mower, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A snow blower auxiliary for a rotary lawn mower of a type having a vertical power shaft normally used for driving the cutter blade of the lawn mower, the snow blower auxiliary comprising:

snow blower means of a type having a support means, including a support member, and a rotatable means by which snow is gathered and forcibly ejected;

first power means, for receiving power drive from the vertical power shaft of the lawn mower, the shaft being the shaft normally used for driving the cutter blade of the mower;

second drive means, by which the power drive of the said first power means is utilized to drive the rotatable means of the snow blower means;

said second drive means including a horizontal power shaft, and a vertical drive shaft operatively interconnected thereto for power-transmission of power received through the said vertical drive shaft and powering the horizontal power shaft therefrom, and including a normally stationary body member means providing a support means with respect to which both the horizontal power shaft and the vertical drive shaft are relatively movable;

the first power means including driver means connected to the vertical drive shaft, and driven means drivably interconnecting the first power means and the said second drive means;

bearing means for supporting the said horizontal power shaft; and the support means of the snow blower means supportingly interconnecting the bearing means to both the support member of the snow blower means and to the deck of the lawn mower, thereby achieving support of the horizontal power shaft of the snow blower means from the lawn mower merely by support from the deck thereof; and the normally stationary body member means being rotatable concentrically with respect to the axis of the horizontal power shaft, the rotation of the body member means about the axis of the horizontal power shaft causing rotation of the vertical drive shaft of the second drive means in a plane perpendicular to the horizontal power shaft.

2. The invention as set forth in claim 1 in a combination in which the driving means of the first power means is a power belt means, a pulley thereof being carried on the vertical drive shaft of the second drive means, and receiving snow blower driving power from the power belt means, and in which spring means are provided for operatively interconnecting the relatively stationary body member means and also the lawn mower deck to bias the drive means in a direction for applying tightness to the power belt means, by causing rotation of the axis of the said vertical drive shaft to move its said pulley in a belt-tightening direction.

* * * * *